US005800226A

United States Patent [19]

Szabad et al.

[11] Patent Number: 5,800,226

[45] Date of Patent: Sep. 1, 1998

[54] MANEUVERABLE BODY BOARD WITH STEP RAIL

[75] Inventors: Gregory Szabad, Oceanside, Calif.; Jon Anthony Glydon, W. Barnstable, Mass.

[73] Assignee: Earth & Ocean Sports, Inc., Hyannis, Mass.

[21] Appl. No.: 716,971

[22] Filed: Sep. 20, 1996

[51] Int. Cl.[6] ..... B63B 35/73

[52] U.S. Cl. ..... 441/65

[58] Field of Search ..... 441/65, 68, 74; 280/18, 19

[56] References Cited

U.S. PATENT DOCUMENTS 4,752,260 6/1988 Stewart ..... 441/65

5,116,269 5/1992 Moran ..... 441/65

*Primary Examiner*—Sherman Basinger

*Attorney, Agent, or Firm*—Richard P. Crowley

[57] ABSTRACT

The invention relates to a sports or body board for use in gliding or sliding on a fluid surface, such as water or snow and/or both. The board is designed with a step deck rail along the length of both sides of the board to decrease rail drag and to increase performance, speed and maneuverability. The step deck rails are created by removing mass, through routing or other shaping, a preferred depth and width along the outside line of the board. The side rails can be created in a variety of shapes, depths and thicknesses as desired by the manufacturer for a particular use. Mass may be removed from either the top or bottom of the side rail or both as desired, and the width, bevel angle, depth and thickness of the step rail or rails may vary as desired.

17 Claims, 3 Drawing Sheets

MANEUVERABLE BODY BOARD WITH STEP RAIL

BACKGROUND OF THE INVENTION

Body boards, also known as sports boards, are devices for gliding on a fluid surface, such as a water or snow surface. Body boards are similar to surf boards, however they tend to be shorter in length and lighter in weight, and generally are required to be more flexible, so that the sports board may be maneuvered by the user in use. Sports or body boards are typically used by an individual in a prone or sitting position, with one or more of the individual's hands grasping one, or usually both, edges of the sports board, so as to guide the sports or body board to gain a measure of control or maneuverability over the board and its direction as it glides over a water, snow or other surface.

Body boards (hereinafter sports boards) have been developed and are known to have a particular beveled shape on the side edges, also known as side rails. Body boards with side rail grip contours are known, and are described for example in U.S. Pat. No. 4,894,034 issued Jan. 16, 1990, and U.S. Pat. No. 5,116,269 issued May 26, 1992, both hereby incorporated by reference.

It is desirable to provide for a new and improved sports or body board which is designed to increase speed, turning and overall performance on a water or snow surface, and which overcomes some of the deficiencies of the prior art body boards, which tend to be less maneuverable and of higher rail drag.

SUMMARY OF THE INVENTION

The invention relates to a sports board characterized by improved speed, turning ability and performance. The sports board of the invention comprises structural features to decrease side rail drag and to increase the performance and speed of the sport board and to provide a looser, faster turning surface. The sports board has reduced flotation material mass along each side rail area to provide a step-down side rail structure, which decreases side rail drag during use, while maintaining the appropriate balance of the sports board between rigidity (stiffness) and thickness (flotation) required in a sports board as used by either a professional or a novice.

Body and sports boards are generally comprised of a semi-rigid foam, e.g. a closed cell flotation core material. It has been discovered that removing foam material from the board deck or surface area adjacent or nearest the side rails forms a step deck side rail surface. This thinned side rail surface causes the fluid (snow or water) to flow with less resistance over the sports board than with prior art boards. Prior art sports board side rails, in section, maintain a thickness level generally equal to or greater than the thickness of the board, or require extra material to be added to the top or bottom deck surface. The step-down side rail structure and design of the invention permits lowering of the planar deck surface of the board on either side of the board, so that thinner side rails are provided on all side rail surfaces. This step-down side rail board structure may be cut or shaped from the top, bottom or both surfaces of the board.

The invention comprises a sports board which generally is an elongated, substantially planar board composed of a semi-rigid, closed cell, foam core flotation material which may be reinforced as desired, and having a planar top user support or deck surface to permit a user to be supported thereon, and a bottom planar smooth gliding surface, a front end, a rear end and having elongated, laterally opposed, beveled side rails, comprising a top rail and a bottom rail, one or both side rails having a stepped down structure from the planar top or bottom surface, or both, to decrease rail drag. The top and bottom rails generally extend from the front end to the rear end of the sports boards and have a generally rounded or triangular shape. The top rail has an upper beveled surface which extends outwardly and downwardly, while the bottom rail has a lower beveled surface which extends inwardly and downwardly to form a generally triangular shape, with the intersection of the top and bottom rails generally rounded. In one preferred embodiment, the lower beveled rail surface is longer than the upper beveled rail surface, and, the thickness of the top rail tends to be only 25% to 45% of the total thickness of the sports board.

The board includes step-down laterally opposed, elongated side rails, particularly but not limited to, top side rails which are stepped down and have a side rail surface which extends below the top planar surface of the board. The stepped down side rails generally extend substantially greater than 50% of the length of the board, and may, in one embodiment, extend the length of the board from the front end to the rear end, and be of generally uniform width and depth throughout the length of the stepped down side rail. The thin side rail sections are usually of sufficient width inwardly, e.g. 1" to 3", to be grasped by the thumb, fingers or hand of a user for control and maneuverability purposes in use. The step depth from the planar surface (top or bottom) may vary, however, in length, and is usually between 40% to 60% of the total surface of the top or bottom rail thickness and particularly may range from 15% to 25% of the total board thickness where a single top or bottom stepped rail design is used, or greater where a top and a bottom step side rail is employed, e.g. 30% to 60% of the total board thickness.

The width, depth and length of the step-down side rail may vary as desired to adjust to side rail drag and the desired performance, speed and maneuverability properties desired. For example, the stepped side rail surface may be a flat width top or bottom side rail surface, or a slightly curved rail surface, like an arcuate surface, extending slightly downwardly and outwardly from the step of depth from the top or bottom planar surface. Usually the stepped side rails on either side of the board are equal and uniform. The depth of the step itself may vary from front to rear, e.g., thicker at the front and then tapered toward the rear. At no time will the step depth exceed the height of the sports board deck surface.

The step, in depth, may be single or in multiple steps downwardly in depth from the planar surface, however, a single step is the preferred embodiment. In a typical sports board about 1½ to 3 inches, e.g., of about two inches in total thickness, the total step-down depth may range from ⅛" to ½" The step in length from the top or bottom planar surface may be quite steep, such as generally perpendicular (90 degrees), or to 45 to 60 degrees, with the flat top side rail surface then extending outwardly to the outside edges of the side top and bottom rails. When desired, the top side rail stepped surface may be textured or otherwise treated to have a friction-type surface to permit the side edge to be easily grasped in use.

The sports board usually is comprised of a lightweight-flotation type material, such as a semi-rigid polymeric, e.g. polyethylene closed cell foam material, to make up the core of the board, with optional laminated layers on the top and bottom surface respectively to provide a friction surface and a smooth gliding bottom surface, such as of a low friction polymer, like a fluoro- or silicone polymer. The foam core may also include textile or other fabric of reinforcing materials therein.

The method of preparing the step deck sports board is to remove material mass from the deck or surface area on either side nearest the side rails. The step deck rail design may be created by routing the board material to a rough desired shape, and thereafter the preferred finer routing is done to arrive at the desired rail shape and optionally the side rails are then smoothed and edges rounded by hand or machine.

The invention will be described for purposes of illustration only in connection with certain preferred and illustrated embodiments, however, it is recognized that those persons skilled in the art may make various additions, improvements, changes and modifications to the illustrated embodiments without departing from the spirit and scope of the invention.

DESCRIPTION OF THE EMBODIMENTS

Figure 1:
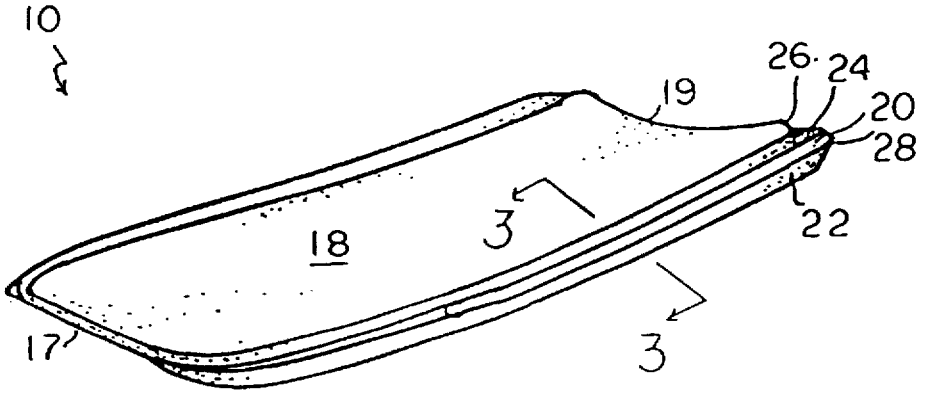
FIG. 1 is a general perspective view of a sports board of the invention.

FIG. 1 shows a perspective view of the sports board 10 from above, with the planar deck surface 18 having front 17 and arcuate rear 19 edges. The side deck rails are shown in FIG. 1 with a beveled angle 26, a step deck surface 24 parallel with deck 18, an outer beveled edge 20, and a bottom beveled angle surface 22, meeting at outer rail edge 28.

Figure 2:
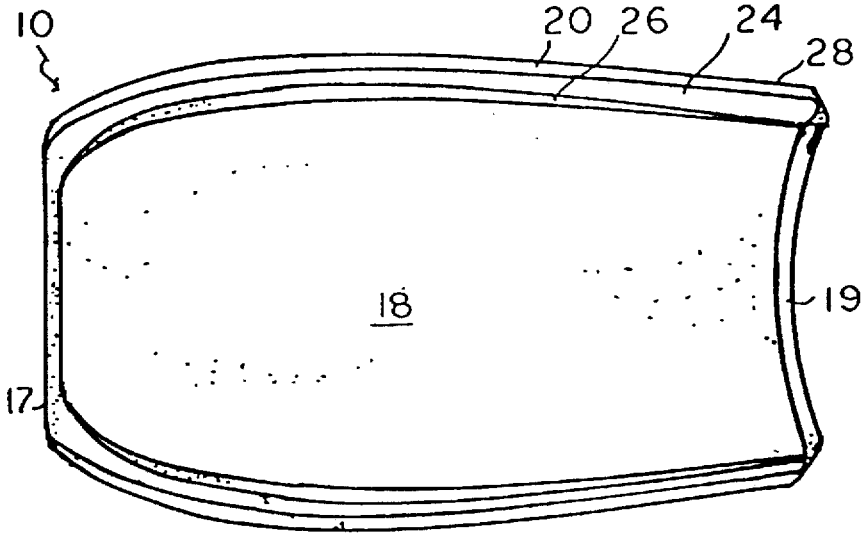
FIG. 2 is a top plan view of the invention of FIG. 1.

FIG. 2 shows the board 10 of FIG. 1 in top plan view, with top deck surface 18, beveled step-down angle 26, planar top step deck surface 24, outer beveled edge 20 and outer rail edge 28.

Figure 3:
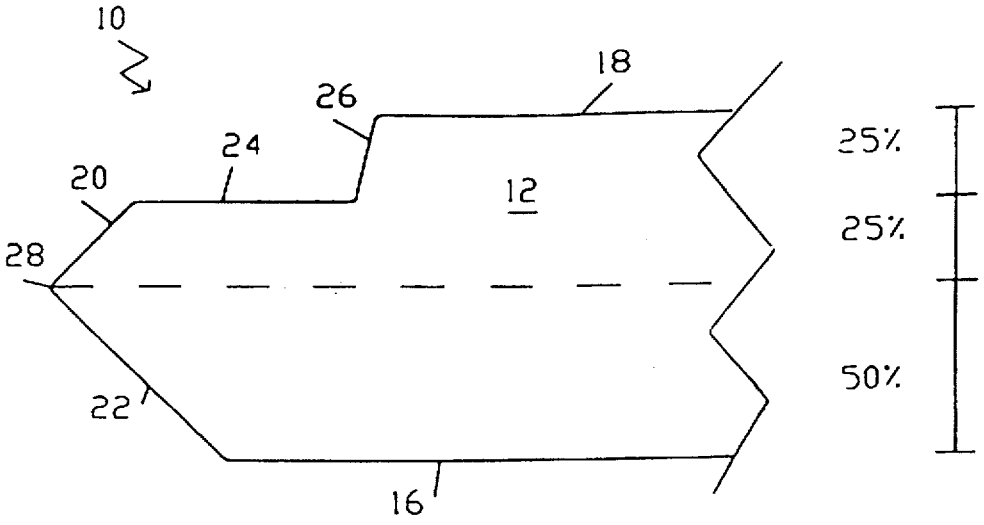
FIG. 3 is an enlarged, cutaway sectional view taken along the line 3—3 of FIG. 1, showing more particularly the sports board of the invention.

FIG. 3 shows the embodiment of FIG. 1 in an enlarged, partially cut away, sectional view. Top planar deck surface 18 of the sports board 10, comprised of a polymeric closed cell foam material 12, is shown with beveled step-down edge 26 cut at about a 75° angle into the sides of the board, creating second planar deck surface 24, in a parallel alignment with the top deck surface 18. The outer beveled step-down edge 20 is shown cut at about a 45° angle and extending outwardly to the outer rail edge 28, where the bottom rail 22 extends inwardly and downwardly at about a 45° angle to the bottom gliding surface 16. A 50/50 cut in the top rail is indicated in this Figure with arrows and dimension lines, with the dimensions of the top and bottom surface also being equal.

Figure 4:
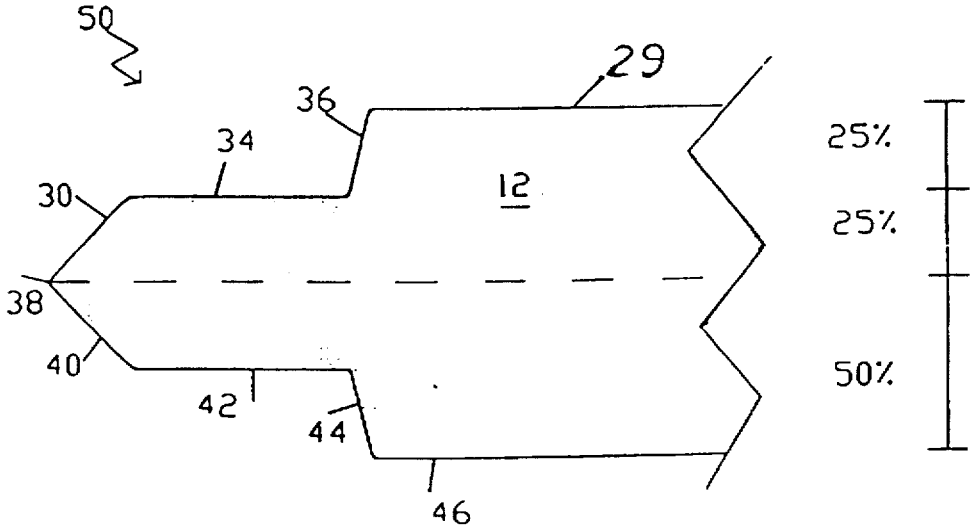
FIG. 4 is an enlarged, cutaway sectional view of an alternate embodiment of the sports board of the invention.

FIG. 4 shows another embodiment of the body board of the invention 50, in an enlarged, partially cut away, sectional view. Top planar deck surface 29 of the board 50 is shown with beveled step-down edge 36 cut at about a 75° angle into the sides of the board, creating second planar deck surface 34 aligned parallel to the top deck surface 29. The outer beveled edge 30 is shown cut at about a 45° angle and extending outwardly to the outer rail edge 38. The bottom rail surface is shown cut in an opposing manner to the top rail surface, with an outer beveled edge 40 extending inwardly and downward from outer rail edge 38 at about a 45° angle and downwardly to a bottom planar step deck surface 42. An inner beveled edge 44 is cut at about a 75° angle and extends downwardly and inwardly to the bottom gliding surface 46.

Figure 5:
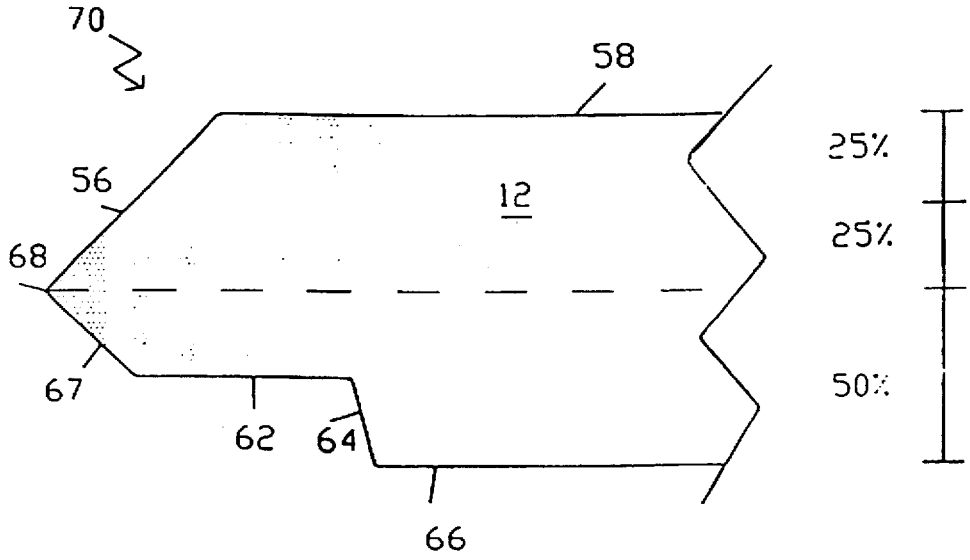
FIG. 5 is an enlarged, cutaway sectional view of a further embodiment of the sports board of the invention.

FIG. 5 shows a further embodiment of the body board of the invention 70, in an enlarged, partially cut away, sectional view. Top planar deck surface 58 of board 70 is shown with beveled step-down edge 56 cut at about a 45° angle into the sides of the board 70, extending outwardly to the outer rail edge 68. The bottom surface has outer beveled edge 67 cut at about a 45° angle extending inwardly and downwardly from the outer rail edge 68 to bottom step deck surface 62, aligned parallel to the deck surfaces. An inner beveled edge 64 is cut and extends downwardly and inwardly to the bottom gliding surface 66.

While the drawings show three alternate embodiments of the step rail sports board of the invention, it is recognized that a wide variety of angles and edge configurations may be employed as desired. Further, the depths, widths and thicknesses of the step-down and deck surfaces may also vary, to create a sports board with the desired enhanced maneuverability and performance as desired.

What is claimed is:

1. A sports board having stepped side rails and adapted for use on a fluid surface, which sports board comprises:

a) an elongated, substantially planar board comprised of a flotation material and having a top planar support deck surface to support a rider, a bottom planar gliding surface for sliding on a fluid surface, a front end, a rear end, and elongated, laterally opposed side edges, said side edges comprising a top rail and a bottom rail, said side edges extending substantially from said front end toward said rear end, said top rail having an upper beveled rail surface and said bottom rail having a lower beveled rail surface to form said side edges;

b) said top rail or said bottom rail or both said top and bottom rails having a stepped edge stepped down a selected depth from the respective planar top deck surface or the bottom planar gliding surface to form a generally lower second top or second bottom, or both, planar stepped rail surface and wherein said stepped rail surface extends to a beveled top or bottom rail surface to decrease rail drag and fluid flow resistance.

2. The board of claim 1 wherein the stepped rail surface extends from said front end to said rear end.

3. The board of claim 1 wherein said stepped rail surface extends a depth of from about ⅛" to ½" below said top planar deck support surface or said bottom planar gliding surface.

4. The board of claim 1 wherein said stepped rail surface comprises a single step from said top or bottom planar surface.

5. The board of claim 1 wherein said stepped rail surface has a width ranging from about 1 to 3 inches.

6. The board of claim 1 wherein the board has a total thickness of about 1½ to 3 inches and the depth of said top rail comprises 25% to 45% of the total thickness of the board.

7. The board of claim 1 wherein said top stepped rail surface tapers inwardly at said front end of the board.

8. The board of claim 1 wherein the stepped top or bottom rail surface extends in thickness about 25% to 45% of the total thickness of the sports board.

9. The board of claim 1 wherein the board comprises a semi-rigid reinforced polymeric foam core flotation material.

10. The board of claim 1 wherein the top rail or bottom rail, or both, have a stepped down rail surface, which step comprises a single, sharply angled step and has a depth of about ⅛" to ½".

11. The board of claim 1 wherein the top rail includes a beveled, outward and downwardly inclined angular top rail surface from an outside edge of the stepped rail surface.

12. The board of claim 1 wherein the bottom rail includes a beveled downward and inwardly inclined angular bottom rail surface from an outside beveled edge of the side edge to the bottom gliding surface.

13. The board of claim 1 wherein both the top and bottom rails include a beveled angular rail surface extending from the side edge to the second top or second bottom stepped rail surface.

14. The board of claim 1 wherein the stepped edge is a single, sharply angled stepped edge from the top planar surface to the second top planar stepped rail surface, the top rail has a downwardly angled, beveled top rail surface extending from an outer edge of the top planar stepped rail surface to the side edge, and the bottom rail has an upwardly angled, beveled bottom rail surface extending from an outer edge of the bottom planar gliding surface to the side edge.

15. The board of claim 1 wherein the board has a single, sharply angled top and a bottom stepped edge and has angled, beveled top and bottom rail surfaces of the top rail and bottom rail, respectively, which extend from the outer edge of the second stepped rail top and bottom surfaces to the side edges.

16. The board of claim 1 which includes: a downwardly angled, beveled top rail surface of the top rail extending from the top planar support deck surface to the side edge; a single, sharply angled bottom stepped edge extending to a second bottom stepped rail surface; and a beveled bottom rail surface of the bottom rail extending from an outer edge of the second bottom stepped rail surface to the side edge.

17. The board of claim 1 wherein the side edge is generally intermediate the total thickness of the board and the top rail and bottom rail having a generally uniform, angular, beveled rail surface of about 45 degrees.

* * * * *